US006706122B2

(12) United States Patent
Wijngaard et al.

(10) Patent No.: US 6,706,122 B2
(45) Date of Patent: Mar. 16, 2004

(54) METHOD FOR REMOVING LAYERS OF HARD MATERIAL

(75) Inventors: Jan Hendrik Wijngaard, Chur (CH); Hans Braendle, Sargans (CH)

(73) Assignee: Unaxis Trading AG, Trubbach (CH)

( * ) Notice: Subject to any disclaimer, the term of this patent is extended or adjusted under 35 U.S.C. 154(b) by 184 days.

(21) Appl. No.: 09/735,723

(22) Filed: Dec. 7, 2000

(65) Prior Publication Data

US 2001/0013356 A1 Aug. 16, 2001

Related U.S. Application Data

(63) Continuation of application No. PCT/CH99/00234, filed on May 31, 1999.

(30) Foreign Application Priority Data

Jun. 11, 1998 (CH) ..... 1269/98
Jul. 1, 1998 (CH) ..... 1404/98

(51) Int. Cl.[7] ..... B08B 3/00
(52) U.S. Cl. ..... 134/26
(58) Field of Search ..... 134/26

(56) References Cited

U.S. PATENT DOCUMENTS 4,889,589 A 12/1989 McComas ..... 156/646
6,432,219 B1 * 8/2002 Wijngaard et al. ..... 134/41

FOREIGN PATENT DOCUMENTS

| | | |
|---|---|---|
| DE | 4101843 | 4/1992 |
| DE | 4110595 | 11/1992 |
| DE | 4339502 | 6/1995 |
| WO | 9207110 | 4/1992 |

* cited by examiner

*Primary Examiner*—Randy Gulakowski
(74) *Attorney, Agent, or Firm*—Notaro & Michalos P.C.

(57) ABSTRACT

A method for removing hard material layers from hard metal substrates by employing a layer removal solution, included introducing between the hard metal substrate and a hard material layer, an intermediate carrier layer made of a material that is differing from the material of the hard material layer and from the metal substrate. A selectively dissolving of the intermediate carrier layer follows by employing a solution such as hydrogen peroxide, through pores of the hard material layer. The removal solution, within a treatment time period, dissolves the material of the intermediate carrier layer more than the material of the hard material layer, such that the hard material layer is removed before it is dissolved as much as the intermediate carrier layer.

20 Claims, No Drawings

METHOD FOR REMOVING LAYERS OF HARD MATERIAL

CROSS-REFERENCE TO RELATED APPLICATION

This is a continuation application of International Application PCT/CH99/00234, filed May 31, 1999 and claims priority on Swiss patent applications 1269/98 filed Jun. 11, 1998 and 1404/98 filed Jul. 1, 1998.

FIELD AND BACKGROUND OF THE INVENTION

The present invention relates to a method for removing layers of hard material, except TiN, from hard metal substrates.

Definition

For the purpose of this disclosure, "hard material layer" means a layer comprising an oxide, nitride, carbide, carbonitride or carboxynitride of at least one element of groups 4, 5, 6, 13, 14 according to the "New IUPAC Notation", for example according to the "CRC Handbook of Chemistry and Physics", CRC Press, 77th Edition, "Periodic Table of Elements", wherein the hard material layers comprising the above listed materials are poorly soluble in solutions comprising $H_2O_2$. TiN is excluded from these hard materials.

German Patent DE 43 39 502 discloses removing, as hard material layers, duplex layers comprising TiN/TiAlN from hard metal substrates by means of complexly composed solutions based on hydrogen peroxide.

The solution applied according to DE 43 39 502 for the layer removal of TiN/TiAlN duplex hard material layers satisfies the requirements for short layer removal times and for the capacity for being carried out only slightly above ambient temperature. But, due to its complex composition, it does not satisfy the requirement for simple [waste] disposal. In addition, the solutions used, which indiscriminately dissolve the TiN and TiAlN layers, lead to an unacceptable degradation of the hard metal substrate surface. The solutions employed are expensive.

SUMMARY OF THE INVENTION

It is the task of the present invention to remedy the above disadvantages and to propose a layer removal method for hard material layers which, on the one hand, retains the advantages of the method known from DE 43 39 502, namely with respect to short layer removal times and layer removal temperature, but, in addition, degrades the hard metal substrate surface far less, is simple in the solution composition and can be readily disposed.

This is attained according to the invention by applying, between the substrate and the hard material layer, a TiN intermediate carrier layer and wherein the hard material layer is removed by selectively dissolving predominantly only the TiN layer, namely through pores of the hard material layer. This also explains why the method according to the invention is not intended for TiN hard material layers themselves, even if this method can be employed quite reasonably in order to remove layers from workpieces with hard material layers of the above type and simultaneously, or basically in the same bath, remove layers from TiN-coated workpieces.

According to the invention it was found that, if the intent is not directed toward the purpose of dissolving the hard material layer itself but toward providing between hard metal substrate and hard material layer an intermediate carrier layer, which can be dissolved substantially more simply than the hard material layer per se, because of the porosity which is always present, in particular, in PVD-applied hard material layers, leads to the undermining of this layer and the dissolving of the intermediate carrier layer. This leads to the fact that the hard material layer, which is not at all, or substantially less, dissolved, falls off.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENTS

In a preferred embodiment of the method, hard material layers are removed which comprise a layer of type $$(E_1, E_2 \ldots E_n)X$$

wherein $E_x$: is an element No. n=x from one of the groups 4, 5, 6, 13, 14 according to the New IUPAC Notation of the Periodic Table of Elements, where X: is at least one element of the group containing N, C, O; and n: is a running parameter, with $n \geqq 2$, in particular with n=2.

The thickness of the intermediate layer is substantially less than that of the functional hard material layer. The intermediate layer thickness $d_z$ is preferably selected as follows:

$$0.01\ \mu m \leqq d_z \leqq 0.5\ \mu m,$$

preferably $$0.01\ \mu m \leqq d_z \leqq 0.3\ \mu m,$$

especially preferred $$0.01\ \mu m \leqq d_z \leqq 0.2\ \mu m.$$

In a further preferred embodiment of the method according to the invention the elements $E_x$—with $1 \leqq x \leqq n$—comprise Al and/or Si and/or Cr and/or boron. In a further preferred embodiment of the method according to the invention the hard material layer comprises a CrC, CrN, CrCN or a WC—C layer.

In a further preferred embodiment of the method according to the invention the hard material layer comprises a TiAlN and/or TiCrN layer, wherein in an especially preferred embodiment the hard material layer comprises a TiAlN layer, therein, in particular preferred, is a TiAlN layer.

The hard material layer preferably has a layer thickness of at least 2 $\mu$m.

As the solution is preferably used a hydrogen peroxide solution, therein preferably with maximally 50 wt. % hydrogen peroxide, in particular preferred with maximally 20 wt. % hydrogen peroxide. To this solution further is preferably added NaOH, this preferably at maximally 5 wt. % in particular preferred maximally 0.5 wt. %.

Further, to the solution is therein preferably added at least one of the substances disodium oxalate, KNa tartrate tetrahydrate, preferably maximally 5 wt. %, in particular preferred maximally 0.5 wt. %. In an especially preferred embodiment, the solution employed comprises, in addition to water, exclusively hydrogen peroxide, preferably at the stated percentages by weight, as well as NaOH, also preferred at the stated percentages by weight, as well as at least one of the listed substances disodium oxalate, KNa tartrate tetrahydrate, also preferably in the stated concentration.

EXAMPLES

Hard metal indexable inserts were coated with a layer packet TiN/TiAlN. The TiN intermediate layer had a thickness of 0.5 $\mu$m, the total thickness of the packet was 4 $\mu$m.

Variant 1

In a solution:

$H_2O_2$: 17.5 wt. % disodium oxalate: 2.5 wt. %

NaOH: 0.25 wt. % the start of the layer removal could already be observe at 50° C. 10 minutes after the coated substrates were place into the solution. Hard material layer pieces of a size up to 30 $mm^2$ became detached. After two hours the layers were completely removed from the substrates without any degradation of the surface of the hard metal substrate having occurred.

Variant 2

Layers were removed from the above discussed coated hard metal indexable inserts at 30° C. in a solution:

$H_2O_2$: 17.5 wt. %

KNa tartrate tetrahydrate: 2.5 wt. %

NaOH: 0.1 wt. %.

Again, the start of the layer removal process could already be observed 10 minutes. Detached hard material layer pieces are clearly visible in the layer-removal solution. After 2 hours, the layers had been removed from the indexable inserts without any degradation of the hard metal substrate surface.

It is evident, that the method according to the invention already has an extremely satisfactory effect at relatively low detachment temperatures, at temperatures, for example, in the range from 20° C. to 60° C.

While specific embodiments of the invention have been shown and described in detail to illustrate the application of the principles of the invention, it will be understood that the invention may be embodied otherwise without departing from such principles.

What is claimed is:

1. A method of manufacturing a hard metal substrate from a hard metal substrate having a hard material layer with pores and an intermediate layer of a chemically different material from the hard material layer, dispose between the hard metal substrate and the hard material layer, the hard material layer and the intermediate layer being made of respective materials that dissolve in a selected layer removal solution comprising hydrogen peroxide, so that the material of the intermediate layer is more readily dissolved in the removal solution than the material of the hard material layer during a selected time period, the hard material layer being selected from the group consisting of an oxide, nitride, carbide, carbonitride, or carboxynitride of at least one element from Group 4, 5, 6, 13, or 14 of the Periodic Table with the exclusion of TiN, and the intermediate layer consisting of TiN, the method comprising the steps of:

applying the selected removal solution comprising hydrogen peroxide to the hard material layer so that the removal solution penetrates the pores of the hard material layer and contacts the intermediate layer to dissolve at least some of the intermediate layer to at least partly release the hard material layer from the hard metal substrate; and after at least some of the intermediate layer has been dissolved by the removal solution, removing the hard material layer from the hard metal substrate.

2. A method as claimed in claim 1, wherein the hard material layer is expressed as $(E_n)$ X, and wherein E is the Group 4, 5, 6, 13 or 14 element of the Periodic Table, X is at least one of N, C and O, and n=2.

3. A method as claimed in claim 1, wherein a layer thickness $d_z$ of the intermediate layer is selected to be 0.01 $\mu m \leqq d_z \leqq 0.5$ $\mu$m.

4. A method as claimed in claim 1, wherein a layer thickness $d_z$ of the intermediate layer is selected to be 0.01 $\mu m \leqq d_z \leqq 0.3$ $\mu$m.

5. A method as claimed in claim 1, wherein a layer thickness $d_z$ of the intermediate layer is selected to be 0.01 $\mu m \leqq d_z \leqq 0.2$ $\mu$m.

6. A method as claimed in claim 1, wherein the Group 4, 5, 6, 13, or 14 elements of the periodic Table comprise at least one of aluminum, silicon, chromium or boron.

7. A method as claimed in claim 1, wherein the hard material layer comprises a CrC, CrN, CrCN or WCC layer.

8. A method as claimed in claim 1, wherein the hard material layer is a CrC, CrN, CrCN or WCC layer.

9. A method as claimed in claim 1, wherein the hard material layer comprises at least one of a TiAlN or a TiCrN layer.

10. A method as claimed in claim 1, wherein the hard material layer comprises a TiAlN layer.

11. A method as claimed in claim 1, wherein the hard material layer is only a TiAlN layer.

12. A method as claimed in claim 1, wherein the hard material layer has a thickness of at least 2 $\mu$m.

13. A method as claimed in claim 1, wherein the hydrogen peroxide removal solution is maximally 50 wt. % hydrogen peroxide.

14. A method as claimed in claim 1, wherein the hydrogen peroxide removal solution is maximally 20 wt. % hydrogen peroxide.

15. A method as claimed in claim 1, wherein NaOH is included in the removal solution.

16. A method as claimed in claim 1, wherein in the removal solution comprises maximally 5.0 wt. % NaHO.

17. A method as claimed in claim 1, wherein the removal solution comprises maximally 0.5 wt. % NaHO.

18. A method as claimed in claim 1, wherein at least on of the substances disodium oxalate and KNa tartrate tetrahydrate are included in the removal solution.

19. A method as claimed in claim 1, wherein at least one of the substances disodium oxalate and KNa tartrate tetrahydrate are included in the removal solution at maximally 5 wt. %.

20. A method as claimed in claim 1, wherein the removal solution comprises, exclusively of water, the hydrogen peroxide with NaHO and at least one of the substances disodium oxalate and KNa tartrate tetrahydrate.

* * * * *